US005161347A

United States Patent [19]

May et al.

[11] Patent Number: 5,161,347

[45] Date of Patent: Nov. 10, 1992

[54] CUTTING DEVICE FOR PLASTIC NETTING

[75] Inventors: Dennis J. May, Moncure Township, Chatham County; David J. Moore, Garner Township, Wake County, both of N.C.

[73] Assignee: Delaware Capital Formation, Inc., Apex, N.C.

[21] Appl. No.: 776,810

[22] Filed: Oct. 15, 1991

[51] Int. Cl.[5] ..... B65B 61/10; B65B 51/05; B65B 51/14

[52] U.S. Cl. ..... 53/138.2; 53/389.3; 83/16; 83/171; 83/856

[58] Field of Search ..... 53/479, 481, 370, 370.7, 53/371.2, 389.3, 138.3, 138.4, 413, 134.1, 134.2, 417, 138.2; 83/171, 856, 16

[56] References Cited

U.S. PATENT DOCUMENTS

| | | | |
|---|---|---|---|
| 2,799,759 | 7/1957 | Blond et al. | 53/479 X |
| 2,977,729 | 4/1961 | Frechtmann et al. | 53/479 X |
| 3,726,060 | 4/1973 | McMillan | 53/138.4 |
| 3,780,488 | 12/1973 | Herrell | 53/479 X |
| 4,069,727 | 1/1978 | Sparks et al. | 83/171 X |
| 4,675,945 | 6/1987 | Evans et al. . | |
| 4,683,700 | 8/1987 | Evans et al. | 83/171 X |
| 4,860,621 | 8/1989 | Totani | 83/171 |
| 4,944,172 | 7/1990 | Evans . | |

*Primary Examiner*—Horace M. Culver
*Attorney, Agent, or Firm*—Allegretti & Witcoff, Ltd.

[57] ABSTRACT

An improved cutting mechanism for cutting plastic netting includes a punch which is movable, toward and away from a heated anvil knife edge.

1 Claim, 3 Drawing Sheets

CUTTING DEVICE FOR PLASTIC NETTING

BACKGROUND OF THE INVENTION

This invention relates to an improved method and apparatus for packaging products, especially food products, in plastic netting material.

Heretofore, it has been a practice to package various products, for example food products such as hams and turkeys, in a woven or knitted netting material. The food product can then be hung in an oven, for example, for cooking or curing. One method for placement of netting about such bulk products requires formation of a sleeve of netting material around the product which is then clipped with a metal clip at each end. In practice the sleeve is first formed for receipt of the product. One end of the sleeve is then sealed with a metal clip. The elongated sleeve next receives the product. The opposite end of the netting is then clipped with a double clipper, the clips being spaced from one another. The netting between the spaced clips is then cut and the packaged product is then separated from the unfilled sleeve material. The packaged product is thus ready for further processing.

Plastic netting materials are commonly used for the described packaging operation. One disadvantage associated with plastic netting material is that during the cutting operation which severs the netting between the two spaced clips, the cutting knife may generate small plastic chards which can possibly contaminate the product. Thus, a need has arisen to provide an improved method and apparatus for cutting such netting.

Prior art, U.S. Pat. No. 4,683,700 disclosed apparatus for cutting or severing plastic netting. The device comprised a movable heated punch which cooperated with a fixed anvil. The device worked, but was not commercially acceptable.

SUMMARY OF THE INVENTION

Briefly, the present invention comprises an improvement in clipper apparatus and, in particular, an improved cutting device which is useful with double clipper mechanisms that attach spaced clips on plastic netting material of the type for packaging bulk products such as a ham or a turkey. The improvement of the present invention replaces prior art mechanical knife constructions which were commonly used to sever plastic netting material. Specifically the improvement of the present invention comprises a heated anvil having a special configuration and which is cooperative with a movable punch that impinges the meltable netting material against the heated anvil. Because of the special construction of the punch and anvil, the plastic netting material, which is meltable, will be severed without the creation of flakes or small chards.

Thus, it is an object of the present invention to provide an improved mechanism for cutting or severing meltable netting material.

Yet another object of the invention is to provide an improved mechanism for severing meltable plastic material constrained between the two metal clips wherein the mechanism may be incorporated with double clipper mechanisms in an easy and functional manner.

Yet a further object of the invention is to provide an economical, easy to manufacture and easily serviced cutting mechanism for gathered plastic netting material.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
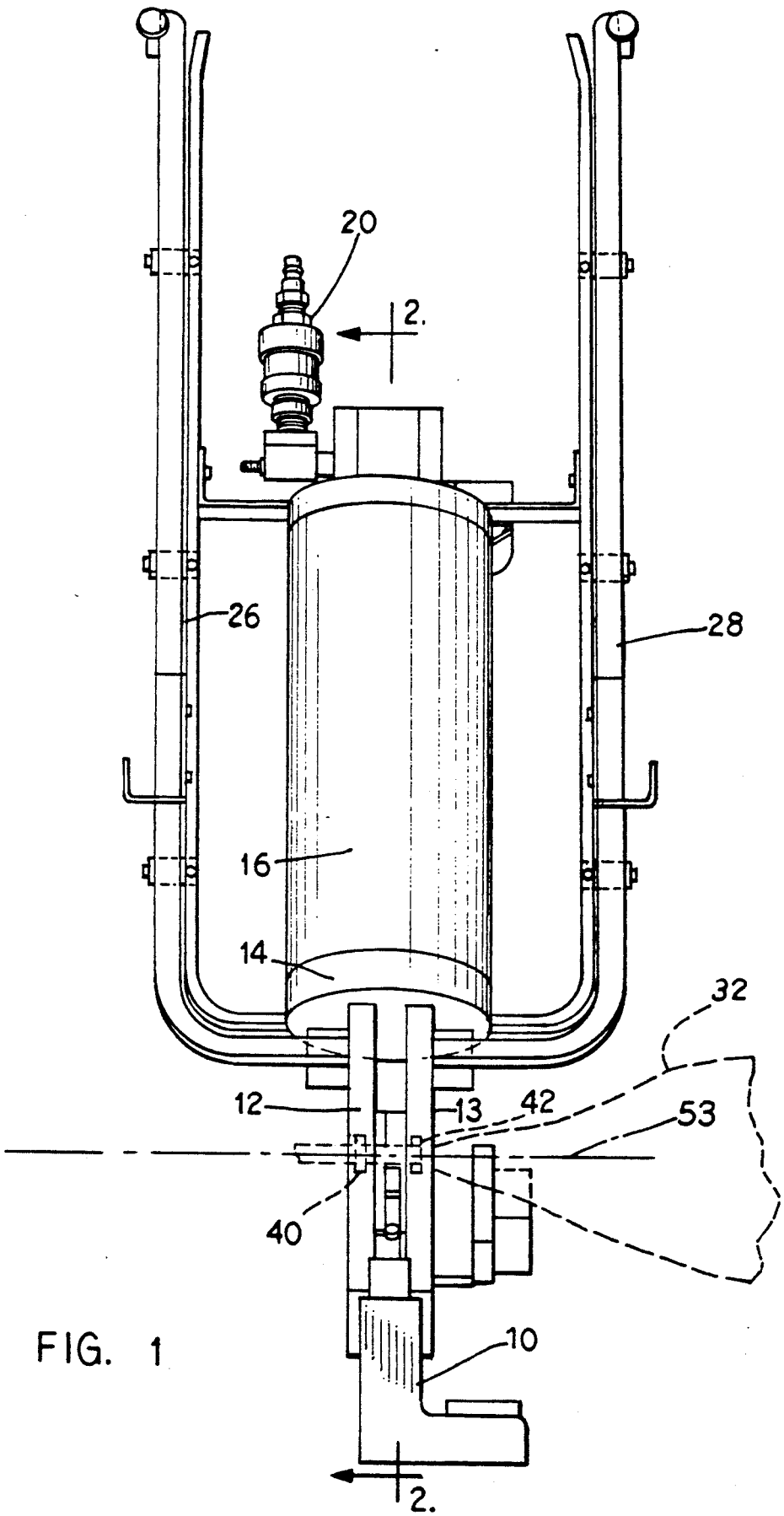
FIG. 1 is a side elevation of netting material as gathered and positioned for attachment of spaced parallel clips in a double clipper mechanism which incorporates the improvement of the present invention.
Figure 2:
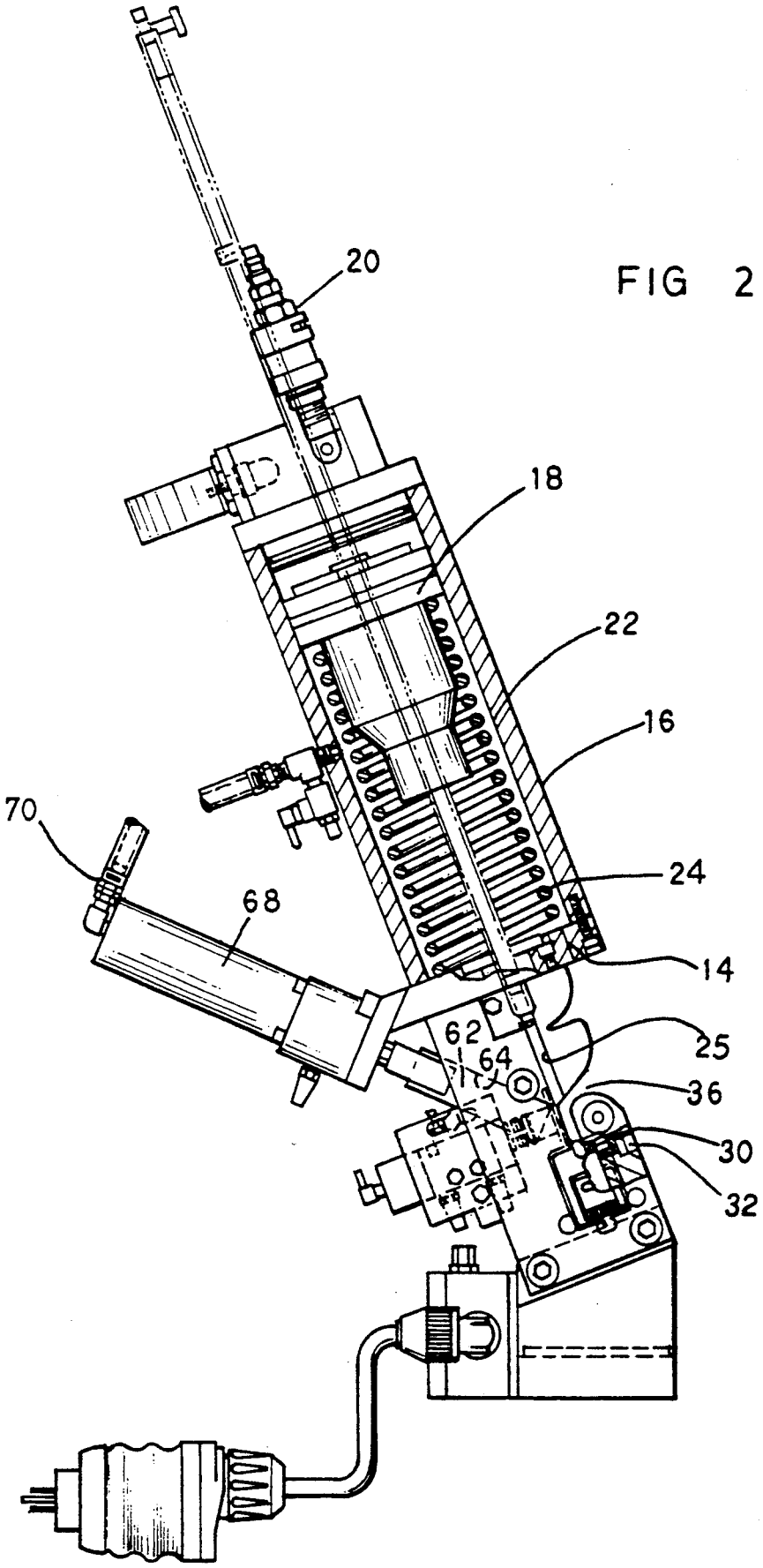
FIG. 2 is a cross-sectional view taken generally along the line 2—2 in FIG. 1 illustrating the construction of the clipper mechanism and the relationship thereof to the improved severing mechanism of the invention.
Figure 3:
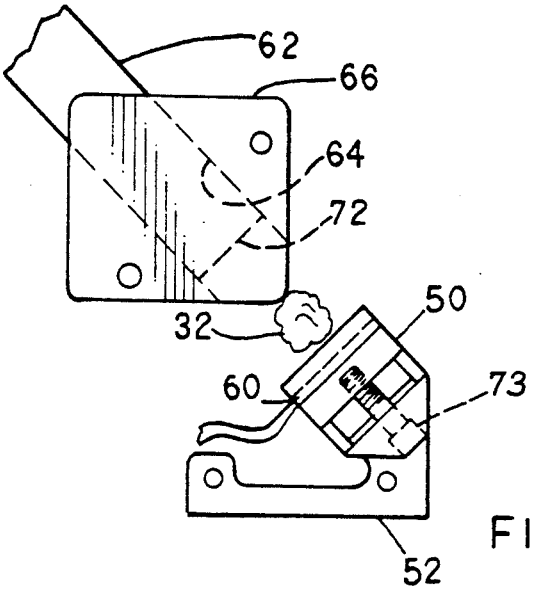
FIG. 3 is an enlarged detail elevation of the improved cutting mechanism of the present invention.

FIG. 1 illustrates a double clipper which is supported on a mounting base 10. Base 10 supports die support plates 12, 13 which, in turn, define a platform for a cylinder support plate 14 mounted thereon. A cylinder 16 on plate 14 includes an internal, sliding piston 18 which is reciprocally driven. Piston 18 is driven downward by means of air pressure through an air inlet conduit 20 and is returned by a spring 22. Pressurized air thus drives the piston 18 and attached parallel punches 24. The punches 24 slidably extend through slots in the die support plates 12, 13 so that U-shaped metal clips which feed from rails 26 and 28 can be driven against a pair of spaced dies such as die 30 in FIG. 2. In this manner, U-shaped metal clips are formed about gathered netting material 32.

The netting material 32 may be provided from a continuous or generally continuous source so that a bulk product, such as a ham or turkey, may be packaged within the unnecked netting 32. The end of the netting 32 is thus gathered or necked to provide a region which is to be clipped by means of a U-shaped metal clip of the type described, for example, in U.S. Pat. No. 4,944,172. Such gathering is effected by maneuvering the netting 32 through a throat 36 in the die support plates 12, 13 over the die 30. Thus as, the punches 24 drive metal clips through appropriate channels 25, clips are formed about the necked netting 32 to tightly close off that netting 32. In this manner, a first clip 40 and second clip 42, shown schematically in FIG. 1, are formed about the netting material 32. The clips 40 and 42 are spaced from one another. U.S. Pat. No. 4,675,945 discloses a typical double clipper of the type described.

The specific improvement of the invention relates to a mechanism or device for cutting the netting 32 between the spaced clips 40 and 42 after or as those clips 40, 42 are applied to the necked netting 32. The netting 32 is typically a plastic netting material which is meltable. The device for severing the netting 32 comprises a heated anvil 50 which is supported on a support bracket 52. The support bracket 52 supports the anvil 50 in a position intermediate the punches for the clips 40 and 42 and adjacent a center line 53 between the dies 30 for the clips 40 and 42.

Figure 4:
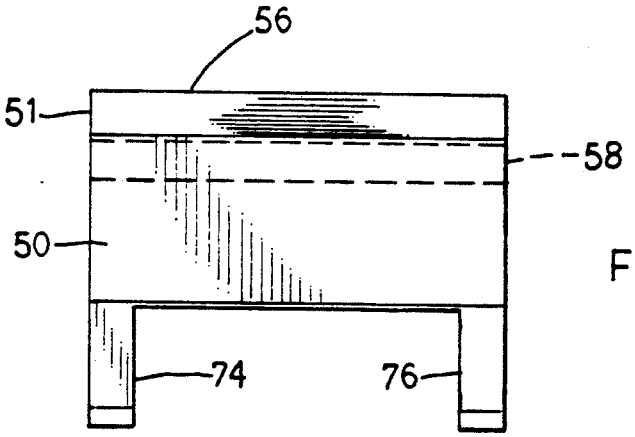
FIG. 4 is a plan view of the anvil of the severing mechanism.
Figure 5:
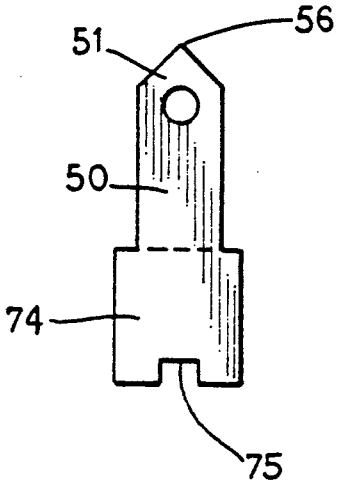
FIG. 5 is an end view of the anvil of the severing mechanism.

The anvil 50 has a preferred configuration. Thus, referring to FIGS. 1, 4 and 5, the anvil 50 has a triangular shaped cross section active end 51 that defines a knife edge or linear edge 56. The linear edge 56 is generally parallel to a passage 58 in the anvil 50. A cartridge heater 60 fits within the passage 58 and is arranged generally parallel to the knife edge 56 so that heat is dissipated uniformly through the knife edge 56 during the cutting operation. A useful heater element is distributed by Atlantic Electric Systems, Inc., Charlotte, North Carolina, as Watlow "Firerod" Model CIE13 cartridge heater.

In opposed relationship to the anvil 50 is a punch 62 which is slidably mounted within a slot or passageway 64 defined in a guide spacer 66. Spacer 66 is retained between and by the die supports 12, 13. The punch 62 is reciprocal and moves in response to an air actuated cylinder 68. The cylinder 68 thus includes a piston and spring combination similar to that associated with the punch cylinder 16. Pressurized air to an air inlet conduit 70 may be arranged in parallel or in a delayed sequence with the air supply to inlet 20 associated with the cylinder 16. In this manner, the clips 40 and 42 are applied substantially simultaneously with the operation of the punch 62 against the anvil 50. The punch 62 includes a generally planer punch surface 72 which is designed to make a line contact with the edge 56 associated with the anvil 50. This further enhances the appropriate cutting and melting operation of the gathered netting 32.

The anvil 50 is retained on the base 52 by means of a single fastener or screw 73 which fits through the base 52 and is screwed into the underside of the anvil 50. The anvil 50 further includes first and second spaced parallel legs 74 and 76 which support the anvil 50 on the base 52 in conjunction with the fastener 72, but which effectively insulate anvil 50 from the base 52 and thus minimize heat transfer into the base 52. Heat transfer is thus maximized by conduction through the knife edge 56 and minimized with respect to conduction through the fastener 72 and support legs 74 and 76. This particular configuration enhances the melting operation and effectively insures conduction of heat toward the netting 32 rather than to the base 52. Note die 50 includes slots 75 in legs 74, 76 to facilitate proper mounting.

With the specific construction of the anvil 50 and punch 62 of the present invention, it is possible to provide an improved mechanism for melting plastic netting which is used to package bulk materials. Various changes may be made however within the spirit and scope of the invention. The invention is therefore to be limited only by the following claims and their equivalents.

We claim:

1. In apparatus for packaging bulk products, said apparatus of the type including first and second clipper mechanisms for attaching first and second spaced metal clips about a meltable sleeve material, the improvement of means for severing the sleeve material between the clippers, said means comprising, in combination:

a generally fixed anvil member positioned intermediate the clipper mechanisms adjacent a center line extending between the clipper mechanisms;

a movable punch member positioned in opposed spaced relation to the fixed anvil member;

means for driving the punch member into the anvil member and for retracting the punch member from the anvil member; and means in the anvil member for heating the anvil member at least to a temperature to melt the sleeve material, said anvil member comprising a block member having a generally straight line edge defined by a triangular shaped cross section end, said block member further including a heating element defining the means for heating, said heating element positioned in a passage generally parallel to the straight line edge to enhance uniform heat conduction to that edge, said anvil member further including spaced legs projecting integrally from the side opposite the edge for supporting the anvil member and for minimizing conduction of heat away from the edge of the anvil member to a mount for the anvil member, the legs further including slots to facilitate mounting of the anvil member by means of a fastener that cooperatively engages the anvil member; and said punch member comprising a generally planar surface opposed to the edge of the anvil member and movable toward the anvil member to define a line of contact therewith whereby the edge will melt through sleeve material and then contact the planar surface of the punch member.

* * * * *